US010053792B2

(12) United States Patent
He et al.

(10) Patent No.: US 10,053,792 B2
(45) Date of Patent: Aug. 21, 2018

(54) PLATING CUP WITH CONTOURED CUP BOTTOM

(71) Applicant: NOVELLUS SYSTEMS, INC., Fremont, CA (US)

(72) Inventors: Zhian He, Lake Oswego, OR (US); Jingbin Feng, Lake Oswego, OR (US); Shantinath Ghongadi, Tigard, OR (US); Frederick D. Wilmot, Gladstone, OR (US)

(73) Assignee: Novellus Systems, Inc., Fremont, CA (US)

( * ) Notice: Subject to any disclaimer, the term of this patent is extended or adjusted under 35 U.S.C. 154(b) by 161 days.

(21) Appl. No.: 14/990,573

(22) Filed: Jan. 7, 2016

(65) Prior Publication Data

US 2016/0115615 A1 Apr. 28, 2016

Related U.S. Application Data

(63) Continuation of application No. 13/609,037, filed on Sep. 10, 2012, now Pat. No. 9,512,538.
(Continued)

(51) Int. Cl.
*C25D 17/06* (2006.01)
*C25D 17/00* (2006.01)
(Continued)

(52) U.S. Cl.
CPC ..... *C25D 17/06* (2013.01); *C25D 7/12* (2013.01); *C25D 17/001* (2013.01);
(Continued)

(58) Field of Classification Search
CPC ..... C25D 7/12–7/126; C25D 17/00; C25D 17/001; C25D 17/004; C25D 17/06
(Continued)

(56) References Cited

U.S. PATENT DOCUMENTS 3,755,946 A 9/1973 Tomlinson et al.
4,466,864 A 8/1984 Bacon et al.
(Continued)

FOREIGN PATENT DOCUMENTS

CN 1316023 A 10/2001
CN 1623012 A 6/2005
(Continued)

OTHER PUBLICATIONS

U.S. Appl. No. 29/431,712, filed Sep. 10, 2012, entitled "Plating Cup With Contoured Cup Bottom."
(Continued)

*Primary Examiner* — Luan V Van
*Assistant Examiner* — Alexander W Keeling
(74) *Attorney, Agent, or Firm* — Weaver Austin Villeneuve & Sampson LLP

(57) ABSTRACT

Disclosed herein are cups for engaging wafers during electroplating in clamshell assemblies and supplying electrical current to the wafers during electroplating. The cup can comprise an elastomeric seal disposed on the cup and configured to engage the wafer during electroplating, where upon engagement the elastomeric seal substantially excludes plating solution from a peripheral region of the wafer, and where the elastomeric seal and the cup are annular in shape, and comprise one or more contact elements for supplying electrical current to the wafer during electroplating, the one or more contact elements attached to and extending inwardly towards a center of the cup from a metal strip disposed over the elastomeric seal. A notch area of the cup can have a protrusion or an insulated portion on a portion of a bottom surface of the cup where the notch area is aligned with a notch in the wafer.

6 Claims, 11 Drawing Sheets

Related U.S. Application Data

(60) Provisional application No. 61/533,779, filed on Sep. 12, 2011.

(51) Int. Cl.
*C25D 17/12* (2006.01)
*C25D 7/12* (2006.01)

(52) U.S. Cl.
CPC ..... *C25D 17/004* (2013.01); *C25D 17/005* (2013.01); *C25D 17/007* (2013.01); *C25D 17/12* (2013.01)

(58) Field of Classification Search
USPC ..... 414/935–941
See application file for complete search history.

(56) References Cited

U.S. PATENT DOCUMENTS 5,000,827 A 3/1991 Schuster et al.
5,221,449 A 6/1993 Colgan et al.
5,227,041 A 7/1993 Brogden et al.
5,281,485 A 1/1994 Colgan et al.
5,482,611 A 1/1996 Helmer et al.
5,723,028 A 3/1998 Poris
5,853,559 A 12/1998 Tamaki et al.
5,985,762 A 11/1999 Geffken et al.
6,071,388 A 6/2000 Uzoh
6,074,544 A 6/2000 Reid et al.
6,080,291 A 6/2000 Woodruff et al.
6,099,702 A 8/2000 Reid et al.
6,110,346 A 8/2000 Reid et al.
6,124,203 A 9/2000 Joo et al.
6,126,798 A 10/2000 Reid et al.
6,139,712 A 10/2000 Patton et al.
6,156,167 A 12/2000 Patton et al.
6,159,354 A 12/2000 Contolini et al.
6,162,344 A 12/2000 Reid et al.
6,176,985 B1 1/2001 Downes, Jr. et al.
6,179,973 B1 1/2001 Lai et al.
6,179,983 B1 1/2001 Reid et al.
6,193,854 B1 2/2001 Lai et al.
6,217,716 B1 4/2001 Fai Lai
6,221,757 B1 4/2001 Schmidbauer et al.
6,251,238 B1 6/2001 Kaufman et al.
6,251,242 B1 6/2001 Fu et al.
6,261,433 B1 7/2001 Landau
6,267,860 B1 7/2001 Brodsky
6,270,646 B1 8/2001 Walton et al.
6,274,008 B1 8/2001 Gopalraja et al.
6,277,249 B1 8/2001 Gopalraja et al.
6,303,010 B1 10/2001 Woodruff et al.
6,309,520 B1 * 10/2001 Woodruff ..... C25D 17/001 204/242
RE37,749 E 6/2002 Poris
6,413,388 B1 7/2002 Uzoh et al.
6,436,249 B1 8/2002 Patton et al.
6,517,689 B1 2/2003 Hongo et al.
6,540,899 B2 4/2003 Keigler
6,551,487 B1 4/2003 Reid et al.
6,579,430 B2 6/2003 Davis et al.
6,589,401 B1 7/2003 Patton et al.
6,612,915 B1 9/2003 Uzoh et al.
6,613,214 B2 9/2003 Dordi et al.
6,627,052 B2 9/2003 Fluegel et al.
6,726,826 B2 4/2004 Johnson et al.
6,755,946 B1 6/2004 Patton et al.
6,755,954 B2 6/2004 Mayer et al.
6,773,560 B2 8/2004 Pedersen et al.
6,800,187 B1 10/2004 Reid et al.
6,869,510 B2 3/2005 Woodruff et al.
6,908,540 B2 6/2005 Kholodenko
6,989,084 B2 1/2006 Tench et al.
6,991,711 B2 1/2006 Sakaki
7,033,465 B1 4/2006 Patton et al.
7,070,686 B2 7/2006 Contolini et al.
7,087,144 B2 8/2006 Herchen
7,169,269 B2 1/2007 Mizohata et al.
D548,705 S 8/2007 Hayashi
D587,222 S 2/2009 Sasaki et al.
7,497,932 B2 3/2009 Dordi
7,522,055 B2 4/2009 Carrender et al.
D609,655 S 2/2010 Sugimoto
D614,593 S 4/2010 Lee et al.
7,935,231 B2 5/2011 Ghongadi et al.
7,985,325 B2 7/2011 Rash et al.
8,172,992 B2 5/2012 Prabhakar et al.
8,377,268 B2 2/2013 Rash et al.
8,398,831 B2 3/2013 Ghongadi et al.
9,512,538 B2 12/2016 He et al.
2002/0000371 A1 1/2002 Mishima et al.
2002/0040853 A1 4/2002 Johnson et al.
2002/0084183 A1 7/2002 Hanson et al.
2002/0108851 A1 8/2002 Woodruff et al.
2002/0144900 A1 10/2002 Keigler
2003/0010641 A1 1/2003 Kholodenko
2003/0085118 A1 5/2003 Tench et al.
2003/0085119 A1 5/2003 Davis et al.
2004/0084301 A1 5/2004 Dordi et al.
2004/0140199 A1 7/2004 Mizohata
2004/0149573 A1 8/2004 Herchen
2005/0189213 A1 9/2005 Woodruff et al.
2005/0284754 A1 12/2005 Herchen et al.
2006/0226000 A1 10/2006 Hanson et al.
2006/0237308 A1 10/2006 Herchen
2006/0246690 A1 11/2006 Dordi et al.
2008/0117051 A1 5/2008 Carrender et al.
2009/0107835 A1 4/2009 Ghongadi et al.
2009/0107836 A1 * 4/2009 Rash ..... C25D 17/02 204/297.01
2010/0006444 A1 * 1/2010 Endo ..... C25D 17/00 205/89
2010/0032310 A1 2/2010 Reid et al.
2010/0044236 A1 * 2/2010 Mayer ..... C23C 18/1601 205/80
2010/0155254 A1 * 6/2010 Prabhakar ..... C25D 17/001 205/157
2010/0212694 A1 * 8/2010 Keigler ..... C25D 7/123 134/18
2011/0181000 A1 7/2011 Ghongadi et al.
2011/0233056 A1 9/2011 Rash et al.
2012/0181170 A1 7/2012 Prabhakar et al.
2013/0062197 A1 3/2013 He et al.
2015/0191843 A9 7/2015 He et al.

FOREIGN PATENT DOCUMENTS

CN 101798698 A 8/2010
CN 103031580 A 4/2013
JP 2002-069698 3/2002
JP 2002-332598 A 11/2002
JP 2002-540011 11/2002
JP 2003-520898 A 7/2003
JP 2004-124138 A 4/2004
JP 2004-270014 9/2004
JP 2010-150659 A 7/2010
KR 10-2008-0007931 1/2008
TW 544811 8/2003
TW 200410296 A 6/2004
TW 200511422 A 3/2005
TW 1237317 8/2005
TW D148167 S1 8/2005
TW I244548 12/2005
TW 201028503 A 8/2010
WO WO 99/041434 8/1999
WO WO 2000/03072 1/2000
WO WO 03/006718 1/2003

OTHER PUBLICATIONS

U.S. Office Action dated May 15, 2003, issued in U.S. Appl. No. 09/927,741.

(56) References Cited

OTHER PUBLICATIONS

U.S. Final Office Action dated Oct. 7, 2003, issued in U.S. Appl. No. 09/927,741.
U.S. Office Action dated Feb. 26, 2004, issued in U.S. Appl. No. 09/927,741.
U.S. Notice of Allowance dated Jun. 1, 2004, issued in U.S. Appl. No. 09/927,741.
U.S. Office Action dated Oct. 8, 2003, issued in U.S. Appl. No. 10/010,954.
U.S. Notice of Allowance dated Feb. 26, 2004, issued in U.S. Appl. No. 10/010,954.
U.S. Notice of Allowance dated Oct. 27, 2005, issued in U.S. Appl. No. 10/309,414.
U.S. Office Action dated Nov. 1, 2011, issued in U.S. Appl. No. 12/633,219.
U.S. Notice of Allowance dated Jan. 12, 2012, issued in U.S. Appl. No. 12/633,219.
U.S. Notice of Allowance dated Mar. 19, 2012, issued in U.S. Appl. No. 12/633,219.
U.S. Office Action dated Oct. 26, 2012, issued in U.S. Appl. No. 13/432,767.
U.S. Final Office Action dated Nov. 26, 2013, issued in U.S. Appl. No. 13/432,767.
U.S. Office Action dated Aug. 14, 2014, issued in U.S. Appl. No. 13/609,037.
U.S. Office Action dated May 12, 2015, issued in U.S. Appl. No. 13/609,037.
U.S. Notice of Allowance dated Sep. 30, 2015, issued in U.S. Appl. No. 13/609,037.
U.S. Office Action dated Mar. 2, 2011, issued in U.S. Appl. No. 11/929,638.
U.S. Notice of Allowance dated May 23, 2011, issued in U.S. Appl. No. 11/929,638.
U.S. Office Action dated Jul. 7, 2010, issued in U.S. Appl. No. 11/932,595.
U.S. Final Office Action dated Nov. 17, 2010, issued in U.S. Appl. No. 11/932,595.
U.S. Notice of Allowance dated Jan. 26, 2011, issued in U.S. Appl. No. 11/932,595.
U.S. Notice of Allowance dated Mar. 8, 2011, issued in U.S. Appl. No. 11/932,595.
U.S. Notice of Allowance (Supplemental Notice of Allowability) dated Mar. 11, 2011, issued in U.S. Appl. No. 11/932,595.
U.S. Notice of Allowance dated Mar. 18, 2011, issued in U.S. Appl. No. 11/932,595.
U.S. Office Action dated Nov. 4, 2011, issued in U.S. Appl. No. 13/154,224.
U.S. Office Action dated Mar. 16, 2012, issued in U.S. Appl. No. 13/154,224.
U.S. Final Office Action dated Jul. 18, 2012, issued in U.S. Appl. No. 13/154,224.
U.S. Notice of Allowance dated Oct. 4, 2012, issued in U.S. Appl. No. 13/154,224.
U.S. Notice of Allowance (Corrected Notice of Allowability) dated Jan. 23, 2013, issued in U.S. Appl. No. 13/154,224.
U.S. Office Action dated May 21, 2012, issued in U.S. Appl. No. 13/079,745.
U.S. Final Office Action dated Sep. 21, 2012, issued in U.S. Appl. No. 13/079,745.
U.S. Notice of Allowance dated Nov. 19, 2012, issued in U.S. Appl. No. 13/079,745.
U.S. Notice of Allowance dated Feb. 7, 2014, issued in U.S. Appl. No. 29/431,712.
U.S. Notice of Allowance dated May 1, 2014, issued in U.S. Appl. No. 29/431,712.
Chinese First Office Action dated May 2, 2013 issued in CN 200910211989.X.
Japanese Office Action dated Oct. 2, 2012 issued in 2009-278998.
Korean Description of Notification of Provisional Rejection, dated May 10, 2012 issued in 2009-0122738.
Korean Notice of Decision to Grant dated Sep. 4, 2012 issued in 2009-0122738.
Singapore Search Report and Written Opinion dated Mar. 9, 2011 issued in 200908245-4.
Singapore Search and Examination Report, dated Oct. 27, 2011, issued in Application No. 200908245.4.
Taiiwan International Search Report, dated Jun. 11, 2012, issued in Application No. 098142112.
Singapore Search Report and Written Opinion dated Dec. 13, 2013 issued in 201206807-8.
Singapore Examination Report dated Jun. 30, 2014 issued in 201206807-8.
Chinese Notification of Correction dated Dec. 5, 2012 issued in CN Design Application No. 201230435448.8.
Korean Preliminary Rejection dated Nov. 12, 2013 issued in KR Application No. 30-2012-0043969.
Japanese Office Action dated Apr. 26, 2013 issued in 2012-022024.
Taiwan Office Action dated May 28, 2013 issued in TW Application No. 101305334.
Shin-Etsu Polymer Co., Ltd., "L-Type Connector," [retrieved on May 23, 2003 at http://www.shinpoly.co.jp./ business/connector/ products_e/l.html?typezeb], 1 page.
Shin-Etsu Polymer Co., Ltd., "SS-Type Connector," [retrieved on May 23, 2003 at http://www.shinpoly.co.jp./ business/connector/ products_e/ss.html?typezeb], 2pp.
Shin-Etsu Polymer Co., Ltd., "L-Type Connector," [retrieved on Feb. 16, 2011 at http://www.shinpoly.co.jp/business/connector/ products_e/l.html?typezeb], 1 page.
Shin-Etsu Polymer Co., Ltd., "SS-Type Connector," retrieved on Feb. 16, 2011 at http://www.shinpoly.co.jp/business/connector/ products_e/ss.homl?typezeb], 2pp.
U.S. Office Action dated Apr. 4, 2016, issued in U.S. Appl. No. 13/609,037.
U.S. Notice of Allowance dated Aug. 3, 2016, issued in U.S. Appl. No. 13/609,037.
U.S. Notice of Allowance [Corrected Notice of Allowability] dated Nov. 7, 2016, issued in U.S. Appl. No. 13/609,037.
Chinese Office Action dated Mar. 3, 2016, issued in Application No. CN 201210354922.3.
Japanese Office Action dated Aug. 23, 2016, issued in Application No. JP 2012-200039.
Taiwan Office Action dated Mar. 4, 2016 issued in TW 101133342.
Chinese First Office Action dated May 17, 2018, issued in Application No. CN 201710089748.7.

* cited by examiner

PLATING CUP WITH CONTOURED CUP BOTTOM

CROSS-REFERENCE TO RELATED APPLICATIONS

This application is a continuation of and claims priority to U.S. patent application Ser. No. 13/609,037, filed Sep. 10, 2012 and titled "PLATING CUP WITH CONTOURED CUP BOTTOM," which claims priority to Provisional U.S. Patent Application No. 61/533,779, filed Sep. 12, 2011 and titled "PLATING CUP WITH CONTOURED CUP BOTTOM," both of which are incorporated by reference herein in their entirety and for all purposes.

TECHNICAL FIELD

This invention relates to the formation of damascene interconnects for integrated circuits, and electroplating apparatuses which are used during integrated circuit fabrication.

BACKGROUND

Electroplating is a common technique used in integrated circuit (IC) fabrication to deposit one or more layers of conductive metal. In some fabrication processes it is used to deposit single or multiple levels of copper interconnects between various substrate features. An apparatus for electroplating typically includes an electroplating cell having a pool/bath of electrolyte and a clamshell designed to hold a semiconductor substrate during electroplating.

During operation of the electroplating apparatus, a semiconductor substrate is submerged into the electrolyte pool such that one surface of the substrate is exposed to electrolyte. One or more electrical contacts established with the substrate surface are employed to drive an electrical current through the electroplating cell and deposit metal onto the substrate surface from metal ions available in the electrolyte. Typically, the electrical contact elements are used to form an electrical connection between the substrate and a bus bar acting as a current source. However, in some configurations, a conductive seed layer on the substrate contacted by the electrical connections may become thinner towards the edge of the substrate, making it more difficult to establish an optimal electrical connection with the substrate.

Another issue arising in electroplating is the potentially corrosive properties of the electroplating solution. Therefore, in many electroplating apparatus a lipseal is used at the interface of the clamshell and substrate for the purpose of preventing leakage of electrolyte and its contact with elements of the electroplating apparatus other than the inside of the electroplating cell and the side of the substrate designated for electroplating.

SUMMARY

Disclosed herein are cups for engaging wafers during electroplating in a clamshell assembly and supplying electrical current to the wafer during electroplating. The cup can comprise an elastomeric seal disposed on the cup and configured to engage the wafer during electroplating, where upon engagement the elastomeric seal substantially excludes plating solution from a peripheral region of the wafer, and where the elastomeric seal and the cup are annular in shape. The cup also can comprise one or more contact elements for supplying electrical current to the wafer during electroplating, the one or more contact elements attached to and extending inwardly towards a center of the cup from a metal strip disposed over the elastomeric seal, and a protrusion attached to and extending from a portion of a bottom surface of the cup. The portion of the bottom surface of the cup is an angular portion for alignment with a notch in the wafer during electroplating.

In some embodiments, the protrusion is provided in a notch area of the cup, where the notch area corresponds to an area of the cup in which the distance from the center of the wafer to the edge of the elastomeric seal is less than in non-notch areas of the cup. In some embodiments, a height of the protrusion is between about 600 micrometers and about 1000 micrometers.

Also disclosed herein are cups for engaging wafers during electroplating in a clamshell assembly and supplying electrical current to the wafer during electroplating. The cup can comprise an elastomeric seal disposed on the cup and configured to engage the wafer during electroplating, where upon engagement the elastomeric seal substantially excludes plating solution from a peripheral region of the wafer, and where the elastomeric seal and the cup are annular in shape. The cup can also comprise one or more contact elements for supplying electrical current to the semiconductor substrate during electroplating, the one or more contact elements attached to and extending inwardly towards a center of the cup from a metal strip disposed over the elastomeric seal, and an insulated portion on a portion of a bottom surface of the cup. The portion of the bottom surface of the cup is an angular portion for alignment with a notch in the wafer during electroplating.

In some embodiments, the insulated portion is provided in a notch area of the cup, where the notch area corresponds to an area of the cup in which the distance from the center of the wafer to the edge of the elastomeric seal is less than in non-notch areas of the cup. In some embodiments, the insulated portion has a lower electronic conductivity than the rest of the bottom surface of the cup. In some embodiments, the insulated portion comprises a plastic.

Also disclosed herein are cups for engaging wafers during electroplating in a clamshell assembly and supplying electrical current to the wafer during electroplating. The cup can comprise an elastomeric seal disposed on the cup and configured to engage the wafer during electroplating, where upon engagement the elastomeric seal substantially excludes plating solution from a peripheral region of the wafer, and where the elastomeric seal and the cup are annular in shape. The cup also can comprise a plurality of contact elements for supplying electrical current to the wafer during electroplating, each of the contact elements attached to and extending inwardly towards a center of the cup from a metal strip disposed over the elastomeric seal. Each of the contact elements in a notch area of the cup is longer than each of the contact elements in a non-notch area of the cup, where the notch area corresponds to an area of the cup where the distance from the center of the wafer to the edge of the elastomeric seal is less than in non-notch areas of the cup.

DETAILED DESCRIPTION

Figure 1:
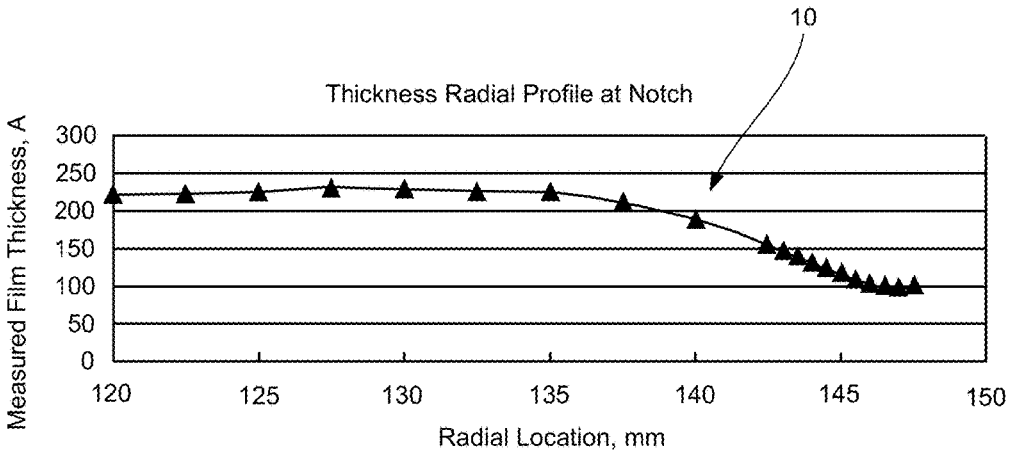
FIG. 1 shows a graph of the thickness of an electroplated layer at a notch area along a radial location of a wafer.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Introduction

As the semiconductor industry is moving towards thinner seed layers used for electroplating, the higher resistance of these thinner layers may impact various aspects of electroplating and in some situation cause defects in the plated layer. The resistance of thinner seed layers often exceeds 5 Ohm/square and sometimes can be as high as about 30 Ohm/square and even about 40 Ohm/square. The higher resistance may cause uneven voltage distribution particularly when contact points are positioned at different distances from electroplating solution boundaries.

One electroplating issue associated with thinner seed layers appears to be present in notch areas of substrates. Specifically, wafers that are 200 millimeters in diameter and above use small notches to convey wafers' orientation. These notches extend toward the centers of their wafers and need to be sealed when the wafers are electroplated. A clamshell that supports and seals such wafers has a notch extension for this purpose, which is often referred to as a "flat". Just like notches, this flat extends towards the center of the wafer and prevents the plating solution from leaking through the wafer. Therefore, the distance between the center of the wafer and solution excluding edge of the flat is slightly less than similar distance in other areas. For example, a 300-millimeter wafer generally has about a 1 millimeter wide exclusion area around its perimeter. In all areas except the notch area, the edge seal is positioned at about 149 millimeters from the center of the wafer. In the notch area, the seal extends about 0.5 millimeters toward the center and is positioned at about 148.5 millimeters from the center.

However, electrical contacts with a seed layer are typically established along the circular boundary that is evenly spaced from the center. The electrical contacts are provided by contact fingers of a contact ring that has a circular shape and generally does not account for any notch areas. This creates a potential issue where in the notch area the contact fingers are further away from the solution than in other areas of the clamshell. This difference is generally the same as the extension of the flat, e.g., 0.5 millimeters for a 300 millimeter wafer. In this situation, the electrical current has to travel through a seed layer a longer distance in the notch area than in the other areas. When a seed layer is particularly thin and resistive, the longer distance may result in a significant voltage drop and a lower voltage at the interface with the electrolyte in the notch area. The lower voltage may result in a slower deposition rate particularly during initial deposition stages when the voltage gradient is still high. As deposition continues, the voltage gradient may reduce due to additional conduction through the deposited layer. Yet, lower initial rates may greatly impact the thickness profile of plated layers, particularly thin plated layers.

Figure 2:
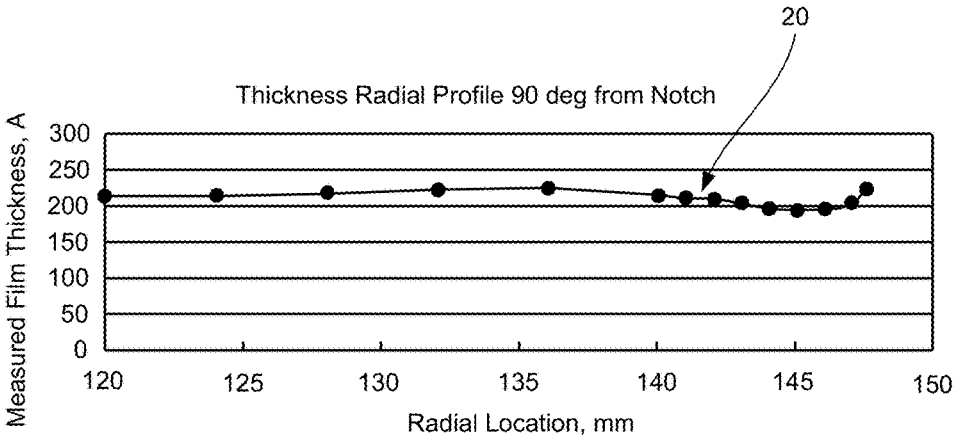
FIG. 2 shows a graph of the thickness of an electroplated layer at a non-notch area along a radial location of a wafer.

This problem can be easily understood from results of the following experiment. A 300 millimeter wafer having a 39 Ohm/square seed layer was electroplated in a conventional clamshell electroplating apparatus with a target thickness of 175 Angstroms. The thickness of the electroplated layer was then inspected in two different areas near the edge of the wafer. One area corresponds to the notch area and its thickness profile is shown in FIG. 1 with line 10. The other area is shifted 90 degrees along the perimeter from the notch area and is representative to any area that does not have a notch. Its thickness profile is shown in FIG. 2 with line 20. The X axis in these graphs represents the distance of the measured point from the center of the wafer, while the Y axis represents the thickness of the deposited layer at this measured location. The focus was mainly the portions near the edge of the wafer, i.e., at distance between 120 millimeters to 150 millimeters from the center where the notch defects tend to occur. Profiles 10 and 20 are comparable for measured points located between 120 millimeters and 135 millimeters from the center. In both areas, the deposited layer was substantially uniform and had a thickness of about 220 Angstroms over this distance from the center. Profile 20 corresponding to the non-notch area shows only slight variation closer to the edge of the wafer, i.e., towards the 150 millimeter position. At the same time, profile 10 corresponding to the notch area indicates that a portion of the deposited layer near the edge is much thinner in this area. Not only this portion near the edge is much thinner than other portions further away from the edge, but this phenomenon is specific only to the notch area and is not present in the other graph.

Other experiments have been conducted to demonstrate that this thickness variation in the notch area is heavily dependent on conductivity of the seed layer. Specifically, more conductive seed layers generally have much lower variability. However, as mentioned above the trend in the semiconductor industry is toward thinner and more resistive seed layers.

Provided are novel clamshells that include cup bottoms having protrusion and/or insulated portions corresponding to notch areas. These features are designed to change distribution of the electrical current within the seed layer and/or within the electrolyte resulting in more uniform electroplating of the entire exposed area of the substrate. For example, a protrusion provided on a bottom surface of the clamshell or, more specifically, on a bottom surface of the cup bottom is used to narrow the gap between the cup bottom and other parts of the plating apparatus and to change the localized current distribution with the electroplating solution. Furthermore, the protrusion results in less current being flown to the dual cathode. The protrusion may extend in the direction substantially perpendicular to the bottom surface. The height of this protrusion depends on various factors, such as the width of the gap between the cup bottom and other hardware portions, conductivity of the seed layer, and the exclusion area difference in the notch area relative to other areas. In certain embodiments, the protrusion is at least about 500 micrometers high, for example, about 1000 micrometers high. This height may be sufficient for a seed layer having resistivity of about 39 Ohm/square and a gap of about 2 millimeters. Thus, the 1000 micrometer protrusion blocks about a half of this gap.

In the same or other embodiments, a portion of the bottom surface of clamshell or, more specifically, of the cup bottom that is adjacent to the notch area has a lower electronic conductivity than the rest of the bottom surface. For example, this portion may be made from a more insulating material, such as plastic, than the rest of the surface of the cup bottom, which may be made from metal. This less conductive portion may be formed by applying an insulating tape strip, coating an insulating coating patch, positioning plastic inserts onto the surface or a cavity formed within the surface, and according to various other methods. This conductivity difference is believed to modify distribution of the electrical current in the plating solution such that the solution adjacent to the insulated conductive portion experiences less current drain to the cathode and, as a result, more material is deposited in the notch area than otherwise.

Whether a clamshell employs a notch area protrusion, notch area insulation, or both, the features are configured in such a way that any increase in deposition rates attributable to these features compensates for reduction in deposition rates due to electrical losses in the seed layer as explained above. Therefore, less conductive seed layers may need to have higher notch area protrusions or a combination of notch area protrusion and notch area insulation. Various factors for selecting and configuring these features are presented above.

Furthermore, a larger exclusion area in the notch area allows moving contact fingers in this area closer to the center of the clamshell without interfering with sealing characteristics of the clamshell. Specifically, a notch area may have longer contact fingers than other areas around the perimeter of the clamshell. While these longer contact fingers would have interfered with the seal in the other areas, the seal extends towards the center in the notch area. In a specific embodiment, these longer contact fingers are configured in such a way that an electronic conductivity path, which is the distance from the fingers to the electrolyte boundary, in the notch area is substantially the same as in the other areas. Therefore, the seed layer exposed to the electroplating solution at the seal interface will have substantially the same potential regardless whether the interface is in the notch area or elsewhere. Longer contact fingers, notch area protrusion, and notch area insulation features may be combined in the same clamshell to achieve more desired effect. As explained above, a notch area protrusion may be made from an insulating material. In the same embodiments, contact fingers may be longer in the notch areas of the clamshell.

Figure 3A:
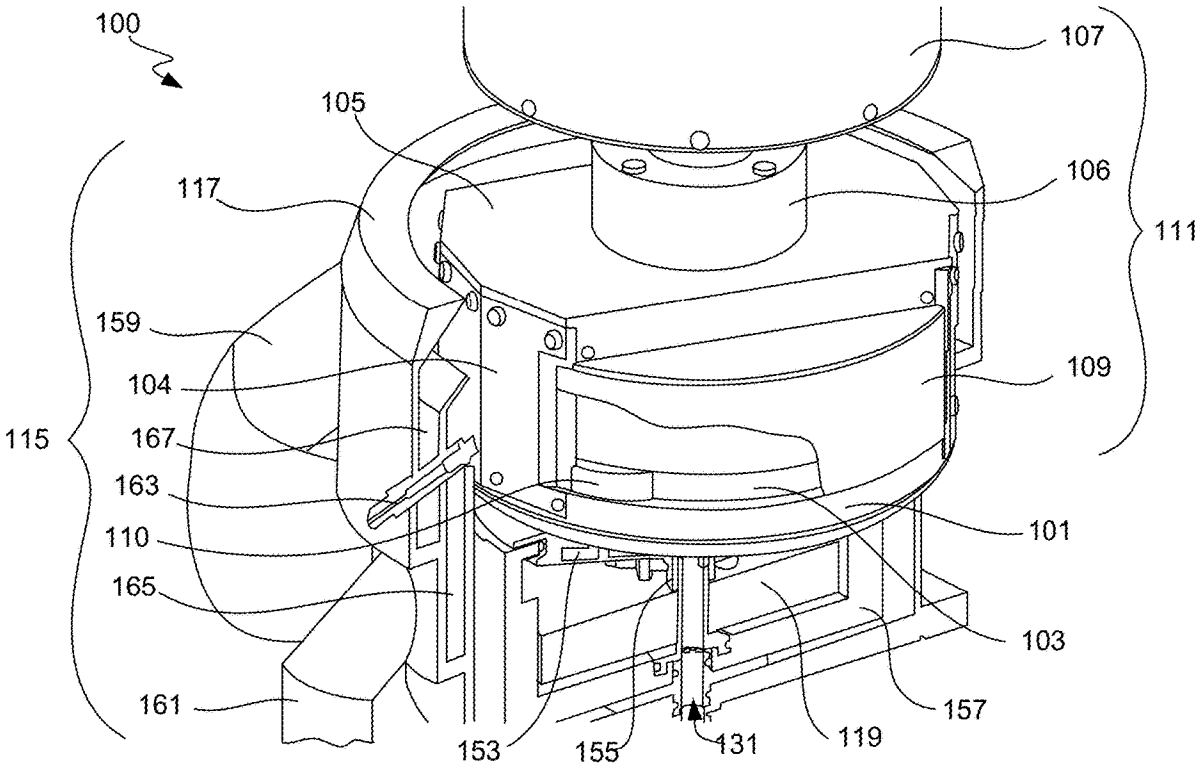
FIG. 3A is a perspective view of a wafer holding and positioning apparatus for electrochemically treating semiconductor wafers.

A brief description of the electroplating apparatus is presented below to provide some context to various embodiments of cup bottoms and contact fingers. FIG. 3A presents a perspective view of a wafer holding and positioning apparatus 100 for electrochemically treating semiconductor wafers. The apparatus 100 includes wafer-engaging components, which are sometimes referred to as "clamshell" components, a "clamshell" assembly, or a "clamshell." The clamshell assembly comprises a cup 101 and a cone 103. As will be shown in subsequent figures, the cup 101 holds a wafer and the cone 103 clamps the wafer securely in the cup. Other cup and cone designs beyond those specifically depicted here can be used. A common feature is a cup that has an interior region in which the wafer resides and a cone that presses the wafer against the cup to hold it in place.

In the depicted embodiment, the clamshell assembly (the cup 101 and the cone 103) is supported by struts 104, which are connected to a top plate 105. This assembly (101, 103, 104, and 105) is driven by a motor 107 via a spindle 106 connected to the top plate 105. The motor 107 is attached to a mounting bracket (not shown). The spindle 106 transmits torque (from the motor 107) to the clamshell assembly causing rotation of a wafer (not shown in this figure) held therein during plating. An air cylinder (not shown) within the spindle 106 also provides a vertical force for engaging the cup 101 with the cone 103. When the clamshell is disengaged (not shown), a robot with an end effector arm can insert a wafer in between the cup 101 and the cone 103. After a wafer is inserted, the cone 103 is engaged with the cup 101, which immobilizes the wafer within apparatus 100 leaving only the wafer front side (work surface) exposed to electrolyte.

In certain embodiments, the clamshell includes a spray skirt 109 that protects the cone 103 from splashing electrolyte. In the depicted embodiment, the spray skirt 109 includes a vertical circumferential sleeve and a circular cap portion. A spacing member 110 maintains separation between the spray skirt 109 and the cone 103.

For the purposes of this discussion, the assembly including components 101-110 is collectively referred to as a "wafer holder" 111. Note however, that the concept of a "wafer holder" extends generally to various combinations and sub-combinations of components that engage a wafer and allow its movement and positioning.

A tilting assembly (not shown) may be connected to the wafer holder to permit angled immersion (as opposed to flat horizontal immersion) of the wafer into a plating solution. A drive mechanism and arrangement of plates and pivot joints are used in some embodiments to move the wafer holder 111 along an arced path (not shown) and, as a result, tilt the proximal end of wafer holder 111 (i.e., the cup and cone assembly).

Further, the entire wafer holder 111 is lifted vertically either up or down to immerse the proximal end of the wafer holder 111 into a plating solution via an actuator (not shown). Thus, a two-component positioning mechanism provides both vertical movement along a trajectory perpendicular to an electrolyte surface and a tilting movement allowing deviation from a horizontal orientation (i.e., parallel to the electrolyte surface) for the wafer (angled-wafer immersion capability).

Note that the wafer holder 111 is used with a plating cell 115 having a plating chamber 117 which houses an anode chamber 157 and a plating solution. The chamber 157 holds an anode 119 (e.g., a copper anode) and may include membranes or other separators designed to maintain different electrolyte chemistries in the anode compartment and a cathode compartment. In the depicted embodiment, a diffuser or membrane 153 is employed for directing electrolyte upward toward the rotating wafer in a uniform front. In certain embodiments, the flow diffuser is a high resistance virtual anode (HRVA) plate, which is made of a solid piece of insulating material (e.g. plastic), having a large number (e.g. 4,000-15,000) of one dimensional small holes (0.01 to 0.050 inch in diameter) and connected to the cathode chamber above the plate. The total cross-section area of the holes is less than about 5 percent of the total projected area, and, therefore, introduces substantial flow resistance in the plating cell helping to improve the plating uniformity of the system. Additional description of a high resistance virtual anode plate and a corresponding apparatus for electrochemically treating semiconductor wafers is provided in U.S. application Ser. No. 12/291,356 filed on Nov. 7, 2008, incorporated herein, in its entirety, by reference. The plating cell may also include a separate membrane for controlling and creating separate electrolyte flow patterns. In another embodiment, a membrane is employed to define an anode chamber, which contains electrolyte that is substantially free of suppressors, accelerators, or other organic plating additives.

The plating cell may also include plumbing or plumbing contacts for circulating electrolyte through the plating cell—and against the work piece being plated. For example, the cell 115 includes an electrolyte inlet tube 131 that extends vertically into the center of anode chamber 157 through a hole in the center of anode 119. In other embodiments, the cell includes an electrolyte inlet manifold that introduces fluid into the cathode chamber below the diffuser/HRVA plate at the peripheral wall of the chamber (not shown). In some cases, the inlet tube 131 includes outlet nozzles on both sides (the anode side and the cathode side) of the membrane 153. This arrangement delivers electrolyte to both the anode chamber and the cathode chamber. In other embodiments, the anode and cathode chamber are separated by a flow resistant membrane 153, and each chamber has a separate flow cycle of separated electrolyte. As shown in the embodiment of FIG. 3A, an inlet nozzle 155 provides electrolyte to the anode-side of membrane 153.

In addition, plating cell 115 includes a rinse drain line 159 and a plating solution return line 161, each connected directly to the plating chamber 117. Also a rinse nozzle 163 delivers deionized rinse water to clean the wafer and/or cup during normal operation. Plating solution normally fills much of the chamber 117. To mitigate splashing and generation of bubbles, the chamber 117 includes an inner weir 165 for plating solution return and an outer weir 167 for rinse water return. In the depicted embodiment, these weirs are circumferential vertical slots in the wall of the plating chamber 117.

As stated above, an electroplating clamshell typically includes a lipseal and one or more contact elements to provide sealing and electrical connection functions. A lipseal may be made from an elastomeric material. The lipseal forms a seal with the surface of the semiconductor substrate and excludes the electrolyte from a peripheral region of the substrate, which houses the contacts. No deposition occurs in this peripheral region and it is not used for forming IC devices, i.e., the peripheral region is not a part of the working surface. Sometimes, this region is also referred to as an edge exclusion area because the electrolyte is excluded from the area. The peripheral region is used for supporting the substrate during processing as well as for establishing the seal with and electrical connections to the substrate. Since it is generally desirable to increase the working surface, the peripheral region needs to be as small as possible while maintaining the function described above. In certain embodiments, the peripheral region is between about 0.5 millimeters and 3 millimeters from the edge of the substrate or, more specifically, about 1 millimeter.

Figure 3B:
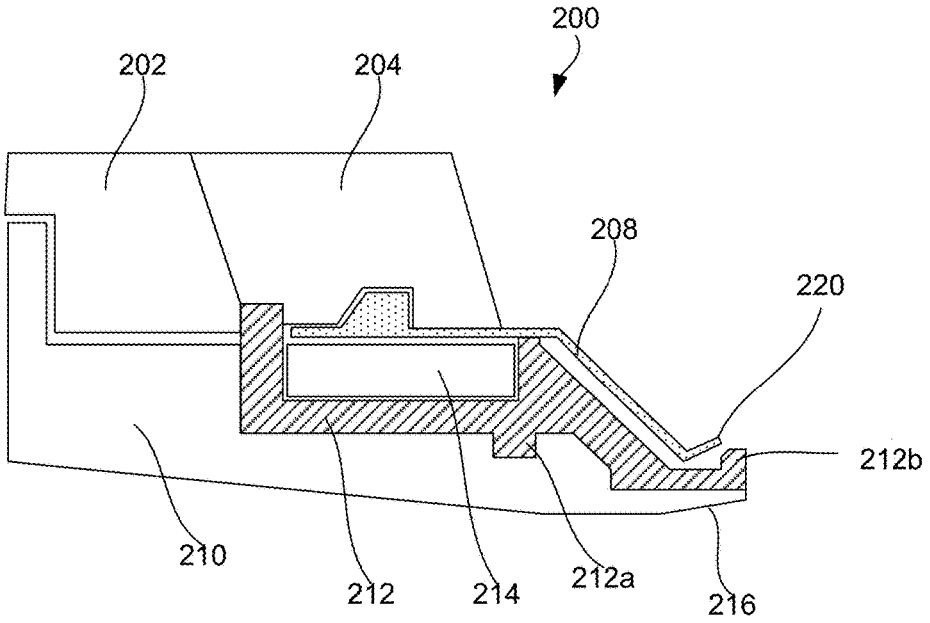
FIG. 3B is a cross-sectional schematic of a clamshell assembly having a lipseal assembly with one or more contact elements.

The following description presents additional features and examples of cup assemblies that may be employed in certain embodiments. Certain aspects of the depicted cup designs provide for greater edge plating uniformity and reduced edge defects due to improved edge flow characteristics of residual electrolyte/rinsate, controlled wafer entry wetting, and lipseal bubble removal. FIG. 3B is an illustrative cut-out view of a cup assembly 200. The assembly 200 includes a lipseal 212 for protecting certain parts of the cup from electrolyte. It also includes a contact element 208 for establishing electrical connection with conductive elements of the wafer. The cup and its components may have an annular shape and be sized to engage wafer's periphery (e.g., a 200-mm wafer, a 300-mm wafer, a 450-mm wafer).

The cup assembly includes a cup bottom 210, which is also referred to as a "disk" or a "base plate" and which may be attached to a shield structure 202 with a set of screws or other fastening means. The cup bottom 210 may be removed (i.e., detached from the shield structure 202) to allow replacing various components of the cup assembly 200, such as a seal 212, a current distribution bus 214 (a curved electrical bus bar), an electrical contact member strip 208, and/or the cup bottom 210 itself. A portion (generally, the outermost portion) of the contact strip 208 may be in contact with a continuous metal strip 204. The cup bottom 210 may have a tapered edge 216 at its innermost periphery, which is shaped in such ways as to improve flow characteristic of electrolyte/rinsate around the edge and improve bubble rejection characteristics. The cup bottom 210 may be made of a stiff, corrosive resistant material, such as stainless steel, titanium, and tantalum. During closing, the cup bottom 210 supports the lipseal 212 when the force is exerted through the wafer to avoid clamshell leakage during wafer immersion. In certain embodiments, the force exerted on the lipseal 212 and the cup bottom 210 is at least about 200 pounds force. The closing force, which is also referred to as closing pressure, is exerted by the clamshell "cone" assembly, the portion of which that makes contact to the wafer backside.

An electrical contact member 208 provides electrical contact conductive materials deposited on the front side of the wafer. Contact member 208 includes a large number of individual contact fingers 220 attached to a continuous metal strip 204. In certain embodiments, the contact member 208 is made out of Paliney 7 alloy. However, other suitable materials can be used. In certain embodiments corresponding to 300-mm wafer configurations, the contact member 208 has at least about 300 individual contact fingers 220 evenly spaced around the entire perimeter defined by the wafer. The fingers 220 may be created by cutting (e.g., laser cutting), machining, stamping, precision folding/bending, or any other suitable methods. The contact member 208 may form a continuous ring, wherein the metal strip 204 defines the outer diameter of the ring, and the free tips of the finger 220 define the inner diameter. It should be noted these diameters will vary depending on the cross-sectional profile of the contact member 208. Further, it should be noted that the fingers 220 are flexible and may be pushed down (i.e., towards the tapered edge 216) when the wafer is loaded. For example, the fingers 220 move from a free position to a different intermediate position when a wafer is placed into the clamshell to yet another different position when the cone exerts pressure onto the wafer. During operation, the lip 212*b* of the elastic lipseal 212 resides near the tips of the fingers 220. For example, in their free position the fingers 220 may extend higher than the lip 212*b*. In certain embodiments, the fingers 220 extend higher than the lip 212*b* even in their intermediate position when the wafer is places into the cup 200. In other words, the wafer is supported by the tips of the fingers 220 and not the lip 212*b*. In other embodiments, the fingers 220 and/or the lip 212*b* seal bend or compress when the wafer is introduced into the cup 200 and both the tips 220 and the lip 212*b* are in the contact with the wafer. For example, the lip 212*b* may initially extend higher than the tips and then be compressed and the fingers 220 deflected and compressed to form contact with the wafer. Therefore, to avoid ambiguity the dimensions described herein for the contact member 208 are provided when a seal is established between the wafer and the lipseal 212.

The seal 212 is shown to include a lipseal capture ridge 212*a* configured to engage with a groove in the cup bottom 210 and thereby hold the seal 212 in a desired location. A combination of the ridge and the groove may help positioning the seal 212 in a correct location during installation and replacement of the seal 212 and may help to resist displacement of the seal 212 during normal use and cleaning. Other suitable keying (engagement) features may be used.

The seal 212 further comprises a feature, such as a groove formed in its upper surface that is configured to accommodate the distribution bus bar 214. The distribution bus bar 214 is typically composed of a corrosion resistant material (e.g., stainless steel grade 316) and is seated within the groove. In some embodiments, the seal 212 may be bonded (e.g., using an adhesive) to the distribution bus 214 for additional robustness. In the same or other embodiments, the contact member 208 is connected to the distribution bus 214 around the continuous metal strip 204. Generally, the distribution bus 214 is much thicker than the continuous metal strip 204 and can therefore provide for more uniform current distribution by enabling a minimal Ohmic voltage drop between the location where the bus bar makes contact with the power lead (not shown) and any azimuthal location where current exits through the strip 204 and the fingers 220 into the wafer.

Figure 4A:
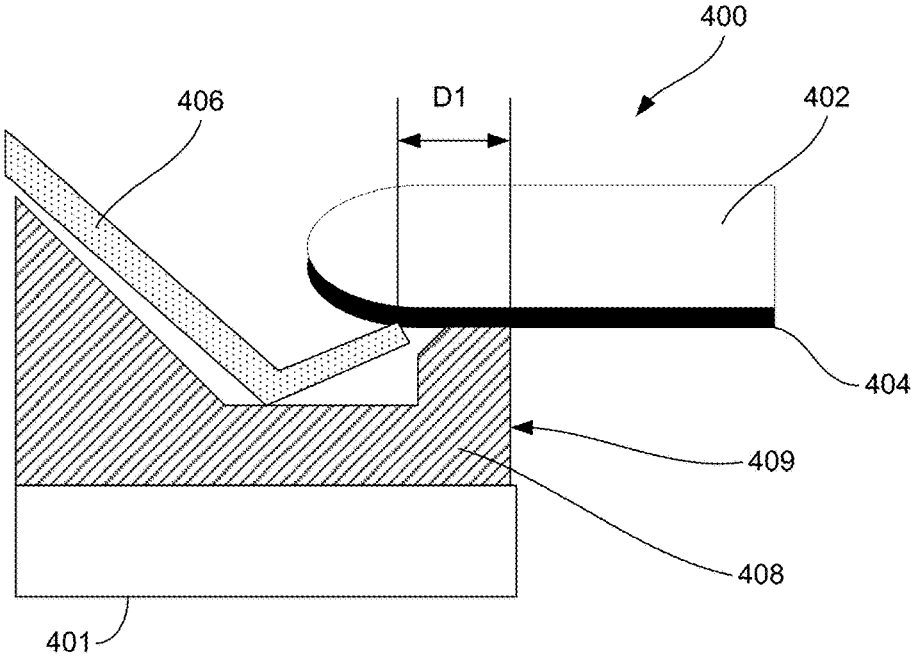
FIG. 4A is a cross-sectional schematic a clamshell assembly in a non-notch area having a lipseal assembly and one or more contact elements supporting a substrate.

FIG. 4A is a schematic illustration of non-notch area of a clamshell 400 with a bottom surface 401 and supporting a substrate 402 showing a non-notch area of this support, in accordance with certain embodiments. Contact fingers 406 make an electrical connection to seed layer 404 of substrate 402. Elastomeric seal 408 forms a seal around its inner edge 409 to prevent electrolyte from reaching contact fingers 406. The deposition area on substrate 402 starts to the right of this inner edge 409. Therefore, an electrical current has to travel through seed layer 404 at least D1 distance before reaching the electrolyte. In certain embodiments, this distance is less than 0.5 millimeters, for example, between about 0.2 millimeters and 0.3 millimeters.

Figure 4B:
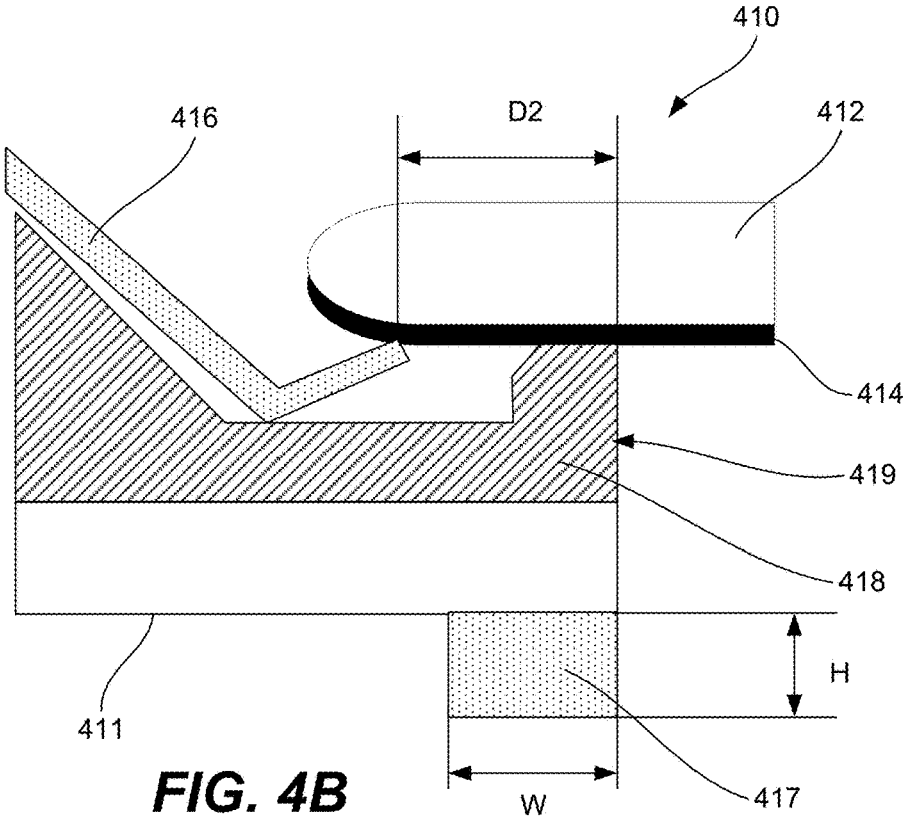
FIG. 4B is a cross-sectional schematic of a clamshell assembly in a notch area having a lipseal assembly and one or more contact elements supporting a substrate, and a bottom surface having a protrusion.

FIG. 4B is a schematic illustration of a notch area of a clamshell 410 supporting a substrate 412, in accordance with certain embodiments. FIGS. 4A and 4B may represent two different cross-sectional views of the same clamshell and substrate that are positioned at different locations along the perimeter of the substrate. Similar to FIG. 4A, contact fingers 416 of this example make an electrical connection to seed layer 414 of substrate 412. Elastomeric seal 418 also forms a seal around its inner edge 419 to prevent electrolyte from reaching contact fingers 416. However, FIG. 4B illustrates the notch area and inner edge 419 in this area is shifted toward the center of substrate 412 and away from contact fingers 416 in comparison to edge 409 in the non-notch area shown in FIG. 4A. The electrical current in the notch area has to travel through seed layer 414 at least D2 distance before reaching the electrolyte, which is longer than the D1 distance. In certain embodiments, the difference between the D2 distance and the D1 distance is between about 0.2 millimeters and 1.0 millimeter, for example, about 0.5 millimeters.

As explained above, the longer conducting path may result in a lower voltage in the seed layer 414 at the edge 419 in comparison a voltage to the edge 409. To compensate for this voltage difference, clamshell 410 may be equipped with a protrusion 417 attached and extending from the bottom surface 411 of clamshell 410. The height (H) of protrusion 417 may be at least about 600 micrometers, for example about 1000 micrometers. Protrusion 417 may extend along the perimeter of edge 419, i.e., perpendicular to the cross-sectional view illustrated in FIG. 4B, to the entire width of the notch area. This dimension may be referred to as a length of protrusion 417. The width (W) of protrusion 417 may be constant or vary along the length, e.g., protrusion 417 may be the widest in the middle of its length and then taper towards both ends. In the initial plating step on substrates 412 with very thin seed layers 414, the dual cathode draws current from the edge of the substrate 412 through a channel formed between the bottom surface 411 and the cell parts (the insert for example). The channel can be between about 1.5 mm and about 2.5, such as about 2.0 mm. The addition of protrusion 417, with a height of H, significantly reduces the opening of the channel, and thus forms a more resistive path locally at the edge 419 where the protrusion 417 is added. This asymmetry in the electrical path for the dual cathode to pull current will compensate for the voltage difference in the seed layer 414 at the edge between substrate 412 in FIG. 4B and the substrate 402 in FIG. 4A, due to the difference between D2 distance in FIG. 4B and D1 distance in FIG. 4A. To be specific, D2 distance in FIG. 4B caused lower voltage at the edge in seed layer 414 of the substrate 412, resulting in less plating as compared to seed layer 404 of the substrate 402. In the meantime, since the dual cathode is pulling less current from the edge 419 in seed layer 414 of the substrate 412, it leads to more plating to the seed layer 414 of the substrate 412. The aforementioned effects caused by two asymmetric features of the bottom surface 411 of the clamshell 410 cancel each other and leads to substantially symmetric plating all around the substrate 412. With this mechanism, the width W, height H, and length of the protrusion 417 can be varied accordingly to achieve the same results. For example, increasing the width W of the protrusion 417 and reducing the height H of the protrusion 417 at the same time can proportionally lead to an equivalent electrical resistive path that is equivalent for the dual cathode to draw current. Similarly, a taper-shaped protrusion as described earlier herein, could be achieved by shaping the protrusion 417 the widest in the middle of its length and then taper towards both ends, or by shaping protrusion 417 the thickest in middle of its length and then taper towards both ends. With a fixed width W for the protrusion 417, the height H of the protrusion 417 can also be changed but still achieve the same profile modulating effect by changing the gap between the bottom surface 411 and the cell part (the insert for example). For example, if the clamshell 410 is moved closer to the cell parts during plating, the protrusion 417 height H can be reduced. In some embodiments, the height H of the protrusion 417 can be between about 600 micrometers and about 1000 micrometers.

Figure 4C:
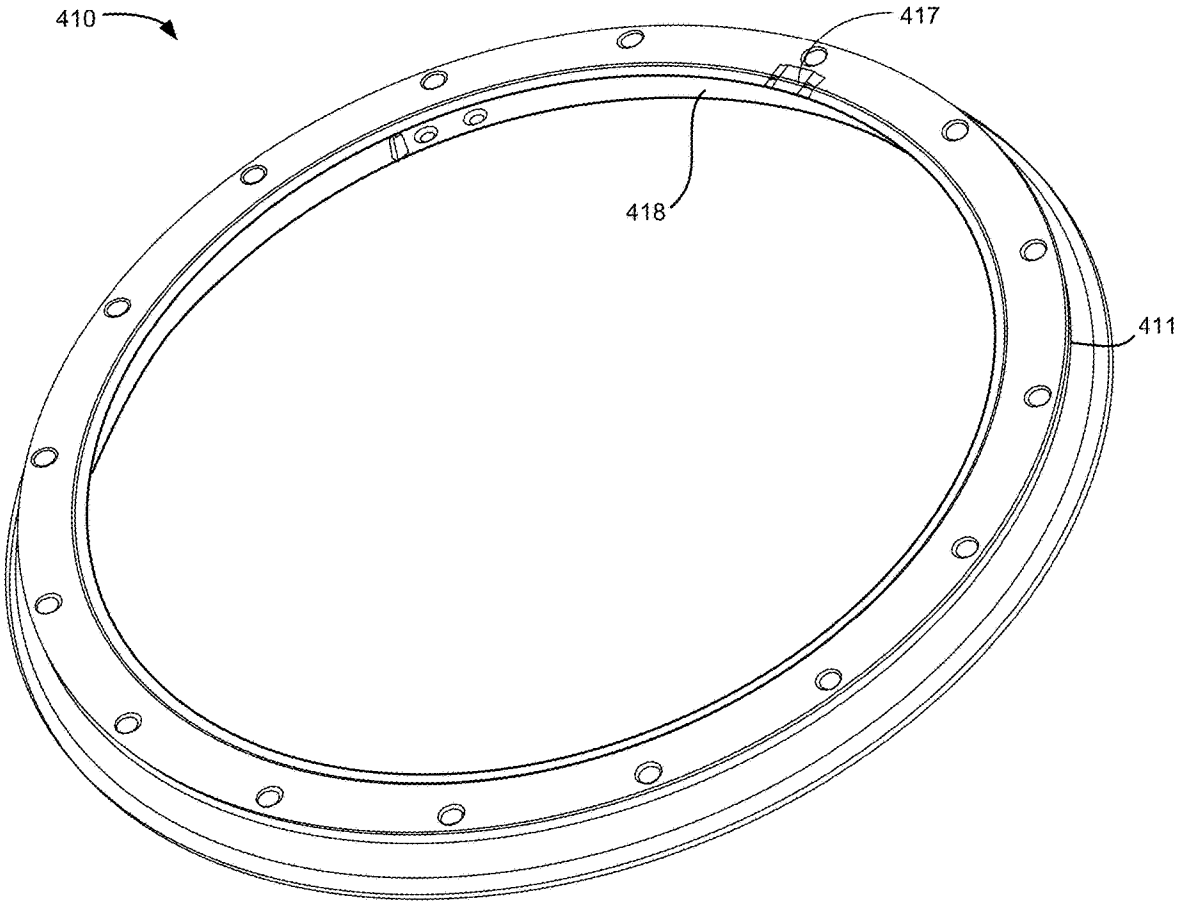
FIG. 4C is a perspective view of a clamshell assembly with a bottom surface having a protrusion.

FIG. 4C is a perspective view of the clamshell 410 in FIG. 4B. The clamshell 410 includes the protrusion 417 attached and extending from the bottom surface 411 of the clamshell 410. As illustrated in FIG. 4C, the width W of the protrusion 417 may partially extend along a width of the bottom surface 411.

Figure 4D:
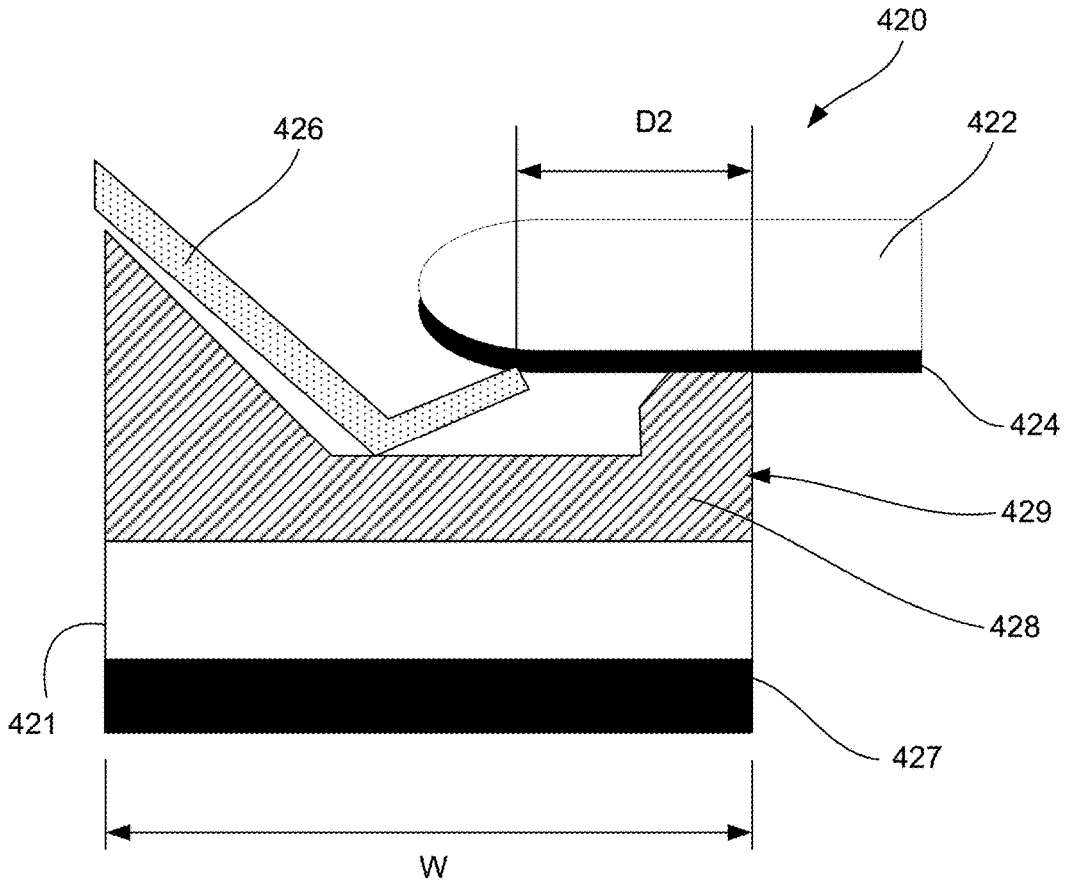
FIG. 4D is a cross-sectional schematic of a clamshell assembly in a notch area having a lipseal assembly and one or more contact elements supporting a substrate, and a bottom surface having an insulated portion.

FIG. 4D is a schematic illustration of another notch area of a clamshell 420 supporting a substrate 422, in accordance with certain embodiments. FIGS. 4A and 4D may represent two different cross-sectional views of the same clamshell and substrate that are positioned at different locations along the perimeter of the substrate. Contact fingers 426 of this example also make an electrical connection to the seed layer 424 of the substrate 422. Elastomeric seal 428 also forms a seal around its inner edge 419 to prevent electrolyte from reaching contact fingers 426 similar to the examples described above with reference to FIG. 4B. The electrical current in the notch area has to travel through the seed layer 424 at least D2 distance before reaching the electrolyte, and, as a result, this seed layer 424 may have a lower voltage at the edge 429. To compensate for this voltage difference, clamshell 420 may be equipped with an insulated portion 427 in the bottom 421 of the clamshell 420. This design could be achieved in various ways. A first approach builds the non-notch portion of the bottom surface 421 with titanium, and the notch portion of cup bottom 421 with plastics. A second approach builds the whole bottom surface 421 with titanium, but with the bottom surface portion near the notch coated with non-conductive coatings while the non-notch region uncoated. The conductive titanium-exposed portion of the bottom surface 421 provides an electrical short path for the dual cathode to pull current, while the insulating notch portion totally block the electrical path for dual cathode to pull current. As described earlier herein with respect to FIG. 4B, this asymmetry in the electrical path for the dual cathode to pull current will compensate for the voltage difference in the seed layer 424 in the substrate 422 at the edge 429 between the seed layer 424 of the substrate 422 in FIG. 4D and the seed layer 404 of the substrate 402 in FIG. 4A, due to the difference between D2 distance in FIG. 4D and distance D1 in FIG. 4A.

Figure 4E:
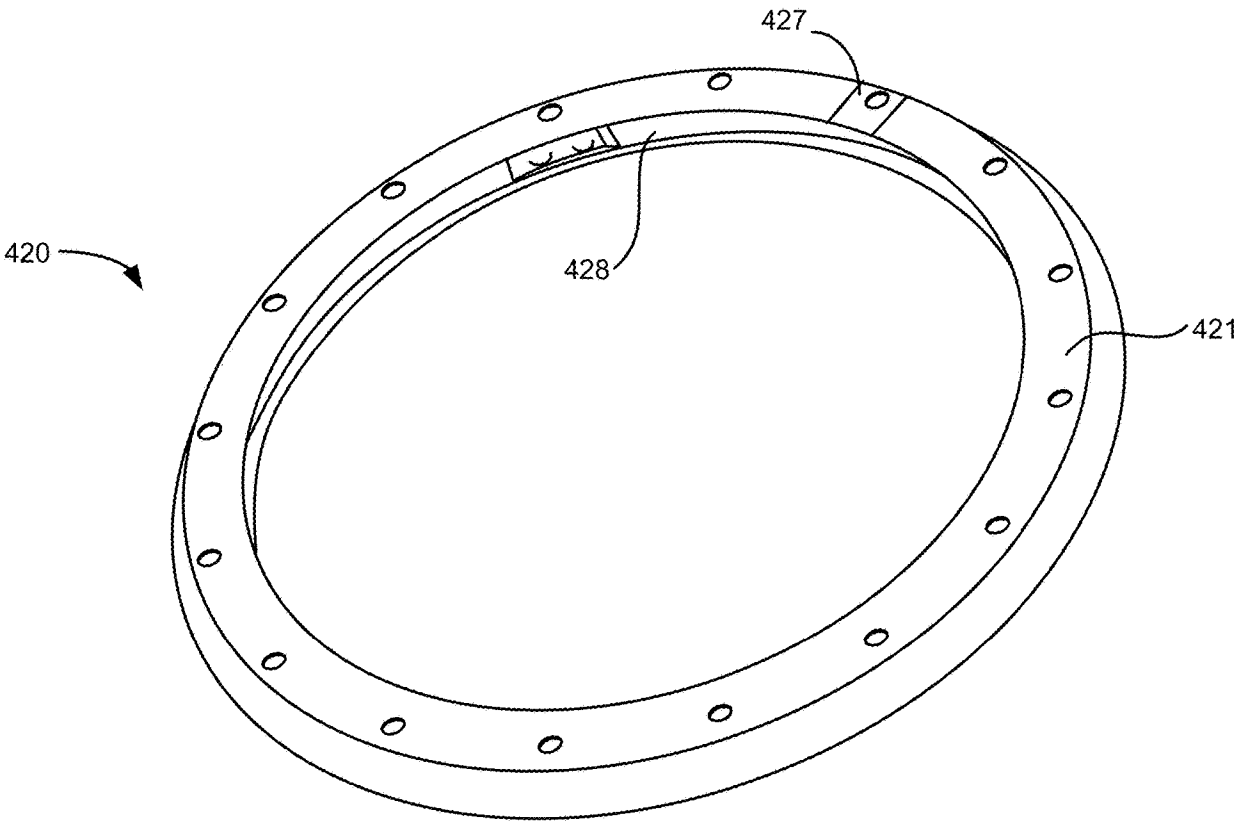
FIG. 4E is a perspective view of a clamshell assembly with a bottom surface having an insulated portion.

FIG. 4E is a perspective view of the clamshell 420 in FIG. 4D. The clamshell 420 includes an insulated portion 427 on the bottom surface 421 of the clamshell 420. As illustrated in FIG. 4E, the width W of the insulated portion 427 may extend along an entirety of the width of the bottom surface 421.

Figure 5A:
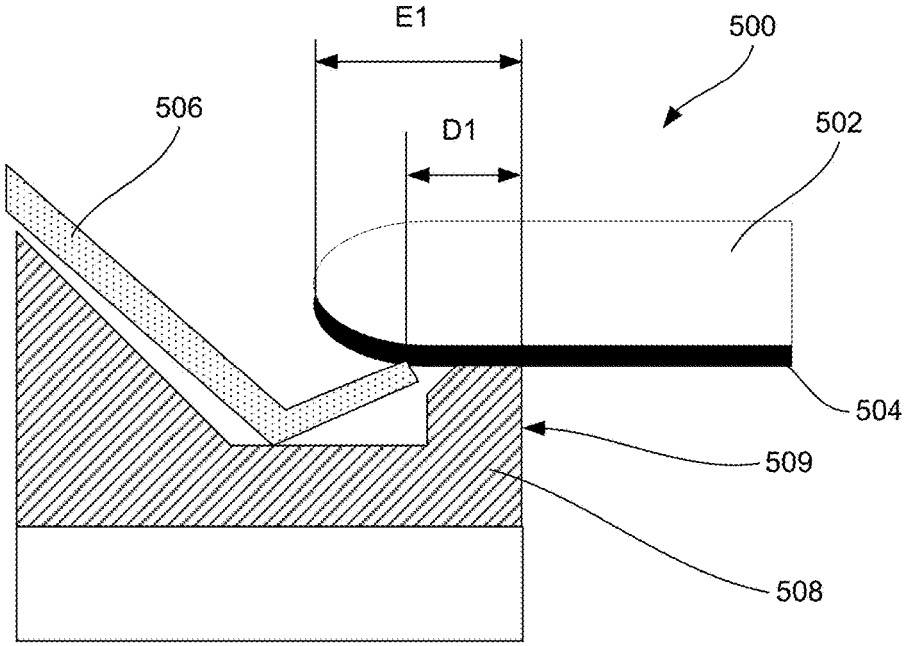
FIG. 5A is a cross-sectional schematic of a clamshell assembly in a non-notch area having a lipseal assembly and one or more contact elements supporting a substrate.
Figure 5B:
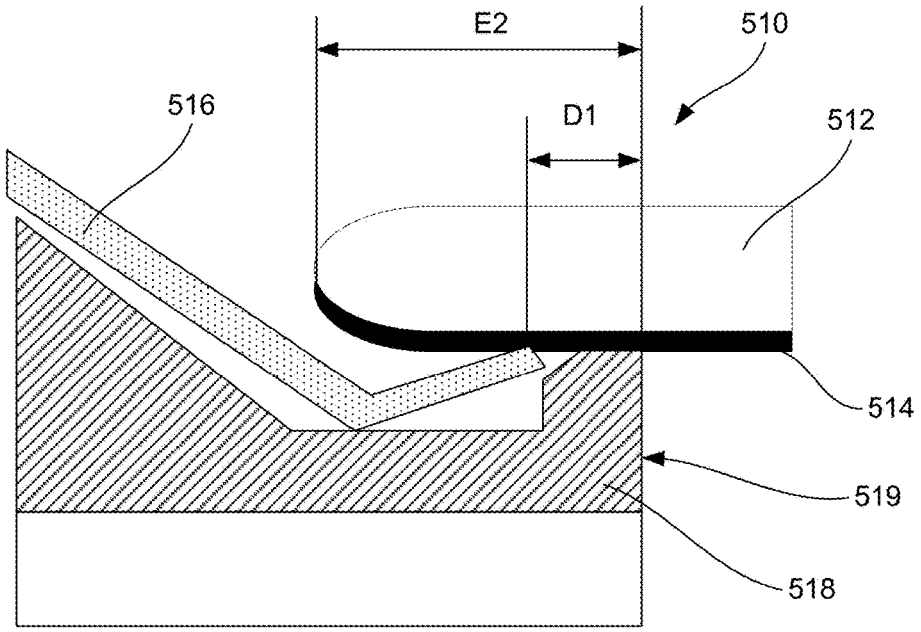
FIG. 5B is a cross-sectional schematic of a clamshell assembly in a non-notch area having a lipseal assembly and one or more contact elements supporting a substrate.

FIG. 5A is a schematic illustration of a non-notch area of a clamshell 500 supporting a substrate 502, in accordance with certain embodiments. This figures is generally similar to FIG. 4A describes above. However, it also illustrates E1 exclusion area, which extends between the edge of substrate 502 and edge 509 of elastomeric seal. FIG. 5B is a schematic illustration of a notch area of a clamshell 510 supporting a substrate 512, in accordance with certain embodiments. FIGS. 5A and 5B may represent two different cross-sectional views of the same clamshell and substrate that are positioned at different locations along the perimeter of the substrate. The E2 exclusion area in the notch area is greater than the E1 exclusion area in the non-notch area in order to accommodate the notch and prevent electrolyte from leaking through the notch and into the contact area. Contact fingers 516 in the notch area are longer than contact fingers 506 in the non-notch areas, which allows preserving the D1 distance the same, i.e., the distance between the contact fingers and the edge of the lipseal, in both notch and non-notch areas. In certain embodiments, this distance is still greater in the notch area than in the non-notch area. However, the increase in this distance going from the non-notch area to the notch-area is smaller than the increase in the exclusion area.

Figure 6:
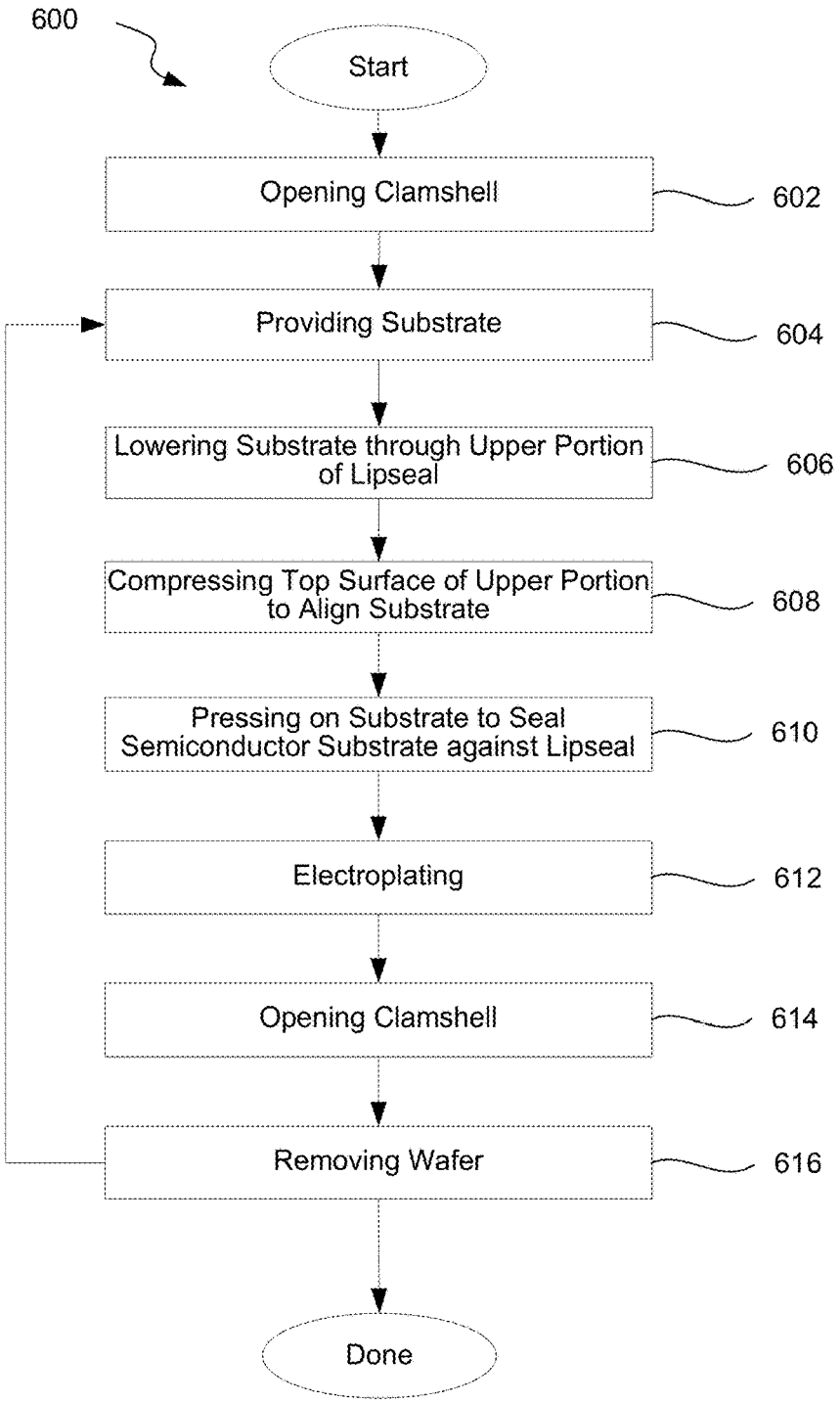
FIG. 6 is a flowchart illustrating a method of aligning and sealing a semiconductor substrate in a clamshell assembly.

Provided also a method of aligning and sealing a semiconductor substrate in a clamshell. The method involves providing a substrate into the clamshell (block 604), lowering the substrate through the upper portion and onto the sealing protrusion (block 606), and compressing the top surface of the upper portion (block 608). During operation 608, the inner side surface is configured to come in contact and push on the semiconductor substrate to align the semiconductor substrate in the clamshell. After aligning the semiconductor substrate during operation 608, the method proceeds with pressing on the semiconductor substrate to form a seal between the sealing protrusion and the semiconductor substrate (block 610). In certain embodiments, compressing the top surface continues during pressing on the semiconductor substrate. For example, compressing the top surface and pressing on the semiconductor substrate are performed by two different surfaces of a cone of the clamshell. In other embodiments, compressing the top surface and pressing on the semiconductor substrate are performed independently by two different components of the clamshell. In these embodiments, compressing the top surface may be stopped when pressing on the semiconductor substrate. Furthermore, a level of compression on the top surface may be adjusted based on the diameter of the semiconductor substrate. These operations may be part of the larger electroplating process. Some other operations are depicted in a flowchart presented in FIG. 6 and are briefly described below.

Initially, the lipseal and contact area of the clamshell may be clean and dry. The clamshell is opened (block 602) and the wafer is loaded into the clamshell. In certain embodiments, the contact tips sit slightly above the plane of the sealing lip and the wafer is supported, in this case, by the array of contact tips around the wafer periphery. The clamshell is then closed and sealed by moving the cone downward. During this closure operation, the electrical contacts and seals are established according to various embodiments described above. Further, the bottom corners of the contacts may be force down against the elastic lipseal base, which results in additional force between the tips and the front side of the wafer. The sealing lip may be slightly compressed to ensure the seal around the entire perimeter. In some embodiments, when the wafer is initially positioned into the cup only the sealing lip is contact with the front surface. In this example, the electrical contact between the tips and the front surface is established during compression of the sealing lip.

Once the seal and the electrical contact are established, the clamshell carrying the wafer is immersed into the plating bath and is plated in the bath while being held in the clamshell (block 612). A typical composition of a copper plating solution used in this operation includes copper ions at a concentration range of about 0.5-80 g/L, more specifically at about 5-60 g/L, and even more specifically at about 18-55 g/L and sulfuric acid at a concentration of about 0.1-400 g/L. Low-acid copper plating solutions typically contain about 5-10 g/L of sulfuric acid. Medium and high-acid solutions contain about 50-90 g/L and 150-180 g/L sulfuric acid respectively. The concentration of chloride ions may be about 1-100 mg/L. A number of copper plating organic additives, such as Enthone Viaform, Viaform NexT, Viaform Extreme (available from Enthone Corporation in West Haven, Conn.), or other accelerators, suppressors and levelers known to those of skill in the art, can be used. Examples of plating operations are described in more details in U.S. patent application Ser. No. 11/564,222 filed on Nov. 28, 2006, which is incorporated herein in its entirety for the purpose of the describing plating operations. Once the plating is completed and appropriate amount of material is deposited on the front surface of the wafer, the wafer is then removed from the plating bath. The wafer and clamshell are spun to remove most of the residual electrolyte on the clamshell surfaces remaining there due to the surface tensions. The clamshell is then rinsed while continued to be spun to dilute and flush as much of the entrained fluid as possible from clamshell and wafer surfaces. The wafer is then spun with rinsing liquid turned off for some time, usually at least about 2 seconds to remove some remaining rinsate. The process may proceed with opening the clamshell (block 614) and removing the processed wafer (block 616). Operations 604 through 616 may be repeated multiple times for new wafers.

In certain embodiments, a system controller is used to control process conditions during sealing the clamshell and/or during processing of the substrate. The system controller will typically include one or more memory devices and one or more processors. The processor may include a CPU or computer, analog and/or digital input/output connections, stepper motor controller boards, etc. Instructions for implementing appropriate control operations are executed on the processor. These instructions may be stored on the memory devices associated with the controller or they may be provided over a network.

In certain embodiments, the system controller controls all of the activities of the processing system. The system controller executes system control software including sets of instructions for controlling the timing of the processing steps listed above and other parameters of a particular process. Other computer programs, scripts or routines stored on memory devices associated with the controller may be employed in some embodiments.

Typically, there is a user interface associated with the system controller. The user interface may include a display screen, graphical software to display process conditions, and user input devices such as pointing devices, keyboards, touch screens, microphones, etc.

The computer program code for controlling the above operations can be written in any conventional computer readable programming language: for example, assembly language, C, C++, Pascal, Fortran or others. Compiled object code or script is executed by the processor to perform the tasks identified in the program.

Signals for monitoring the process may be provided by analog and/or digital input connections of the system controller. The signals for controlling the process are output on the analog and digital output connections of the processing system.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

EXPERIMENTAL RESULTS

Figure 7A:
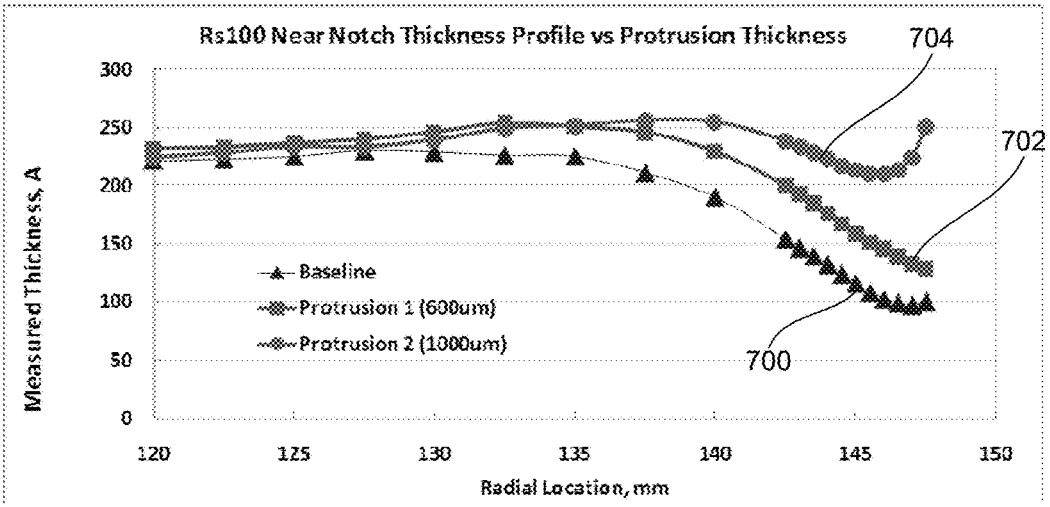
FIG. 7A shows a graph of three thickness profiles of electroplated layers in the notch areas along radial locations of a wafer.

Three different clamshells have been tested for depositing a 175 Angstrom thick layer over a 39 Ohm/square seed layer provided in 300-micrometer wafer. One clamshell did not have any protrusions on its bottom surface. Another clamshell had a 600 micron protrusion, while yet another clamshell has a 1000 micron protrusion. Wafers processed in these three clamshells were measured to determine thickness profiles of the deposited layer. The results of this experiment are presented in FIGS. 7A and 7B. Specifically, FIG. 7A illustrates three thickness profiles in the notch areas near the edges of the wafers. The focus was mainly the portions near the edge of the wafer, i.e., at distance between 120 micrometers to 150 micrometers from the center where the notch defects tend to occur as explained above. Line 700 represents a thickness profile of a wafer processed with a clamshell that did not have any protrusions. It shows a significant drop in thickness near the edge. Line 702 represents a thickness profile of a wafer processed with a clamshell that has a 600-micrometer protrusion. It showed a slight improvement over the thickness profile corresponding to line 700, but still a substantial drop in thickness near the edge. This indicates that the 600-micrometer protrusion for this type of wafers and processing conditions. Line 704 represents a thickness profile of a wafer processed with a clamshell that has a 1000-micrometer protrusion. It showed a rather consistent thickness through the entire radius range.

Figure 7B:
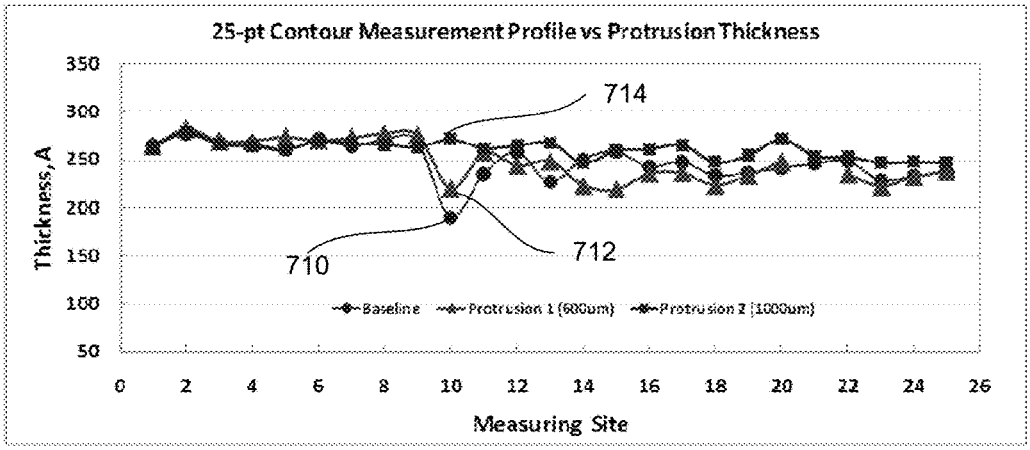
FIG. 7B shows a graph of three 25-point contour measurement profiles with a notch point corresponding to measurement site 10.
Figure 7C:
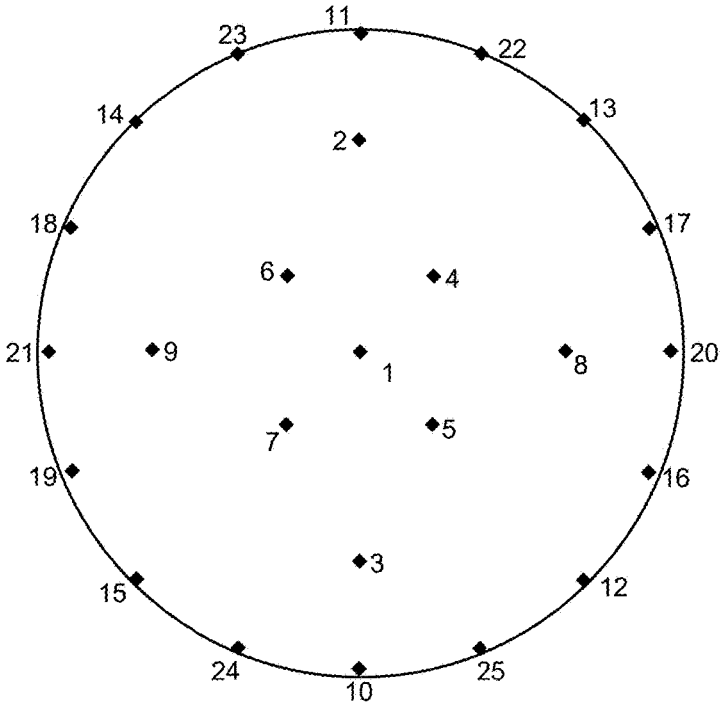
FIG. 7C shows a schematic diagram of 25 locations of measuring sites on a wafer for the 25-point contour measurement profiles in FIG. 7B.

FIG. 7B illustrates a 25-point contour measurement profile, where the measurement site 10 corresponding to the notch point. Locations of other measurement sites are shown in FIG. 7C. Line 710 represents a thickness profile of a wafer processed with a clamshell that did not have any protrusions. Line 712 represents a thickness profile of a wafer processed with a clamshell that has a 600-micrometer protrusion, while line 714 represents a thickness profile of a wafer processed with a clamshell that has a 1000-micrometer protrusion. Similar to results explained above, these results clearly indicate that notch effect could be minimized and even completely eliminated when an optimal protrusion was used.

The impact of cup bottom size and thickness on near edge profile were modeled with FlexPDE software. Current density distributions on two clamshell configurations were modeled, i.e., a standard clamshell and a clamshell that is 1000-micrometer thicker. The modeling results were very consistent with the test results, where a thicker cup bottom compensates the effect of smaller cup bottom inner diameter.

Another test showed that the protrusion concept will also work for seeds other than 39 ohm/sq. A range of thickness of the protrusion could be used to achieve similar results.

CONCLUSION

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

We claim:

1. A cup for engaging a wafer during electroplating in a clamshell assembly and supplying electrical current to the wafer during electroplating, the cup comprising:

an elastomeric seal disposed on the cup and configured to engage the wafer at an inner edge of the elastomeric seal during electroplating, wherein upon engagement the elastomeric seal substantially excludes plating solution from a peripheral region of the wafer, wherein the elastomeric seal and the cup are annular in shape;

a plurality of contact elements for supplying electrical current to the wafer during electroplating, each of the contact elements attached to and extending inwardly towards a center of the cup from a metal strip disposed over the elastomeric seal; and wherein each of the contact elements in a notch area of the cup is longer than each of the contact elements in a non-notch area of the cup by an amount so that a distance between a terminal end of the contact element and an inner edge of the elastomeric seal in the notch area is at least substantially the same as a distance between a terminal end of the contact element and an inner edge of the elastomeric seal in the non-notch area, wherein the notch area corresponds to an area of the cup in which the distance from the center of the wafer to the edge of the elastomeric seal is less than in non-notch areas of the cup.

2. The cup of claim 1, further comprising a protrusion attached to and extending from a portion of a bottom surface of the cup below the inner edge of the elastomeric seal, wherein the portion of the bottom surface of the cup is an angular portion aligned with a notch in the wafer during electroplating, the protrusion being positioned to reduce electrical current drawn from the peripheral region of the wafer during electroplating.

3. The cup of claim 1, further comprising an insulated layer coated on a portion of a bottom surface of the cup that spans a width of the portion of the bottom surface of the cup and is below the elastomeric seal, wherein the insulated layer includes an electrically insulating material and the portion of the bottom surface of the cup includes an electrically conductive material, wherein the portion of the bottom surface of the cup is an angular portion aligned with a notch in the wafer during electroplating, the insulated layer configured to reduce electrical current drawn from the peripheral region of the wafer during electroplating.

4. The cup of claim 1, wherein the elastomeric seal has a diameter that is configured to engage the peripheral region of the wafer.

5. The cup of claim 1, wherein the current density distribution around the perimeter of the wafer is substantially uniform.

6. The cup of claim 1, wherein each of the contact elements in the notch area is longer than each of the contact elements in the non-notch area of the cup by an amount so that an electric potential at an interface with the plating solution in the notch area is substantially the same as an electric potential at the interface with the plating solution in the non-notch area.

* * * * *